US005759345A

United States Patent [19]

Bobik et al.

[11] Patent Number: 5,759,345

[45] Date of Patent: Jun. 2, 1998

[54] PROCESS FOR TREATING SULPHUR-CONTAINING SPENT LIQUOR USING MULTI-STAGE CARBONIZATION

[75] Inventors: Michael Bobik; Dieter Chybin; Alfred Glasner; Karin Taferner, all of Graz, Austria

[73] Assignee: Austrian Energy & Environment SGP/Waagner-Biro GmbH, Vienna, Austria

[21] Appl. No.: 549,727

[22] PCT Filed: Mar. 31, 1994

[86] PCT No.: PCT/AT94/00038

§ 371 Date: Oct. 5, 1995

§ 102(e) Date: Oct. 5, 1995

[87] PCT Pub. No.: WO94/23124

PCT Pub. Date: Oct. 13, 1994

[30] Foreign Application Priority Data

Apr. 5, 1993 [AT] Austria ..... 682/93

[51] Int. Cl.[6] ..... D21C 11/12

[52] U.S. Cl. ..... 162/30.1; 162/30.11; 162/36

[58] Field of Search ..... 162/29, 30.1, 30.11, 162/31, 36; 423/DIG. 3

[56] References Cited

U.S. PATENT DOCUMENTS

| | | | |
|---|---|---|---|
| 3,366,535 | 1/1968 | Cann | 162/30 |
| 3,826,710 | 7/1974 | Anderson | 162/36 |
| 4,148,684 | 4/1979 | Farin | 162/36 |
| 4,941,945 | 7/1990 | Pettersson | 162/29 |

FOREIGN PATENT DOCUMENTS

| | | |
|---|---|---|
| 0538576 | 4/1993 | European Pat. Off. . |
| 7317299 | 2/1973 | Japan . |

OTHER PUBLICATIONS

Hauki, T., "TRP in the Kraft Proc. . . . Chemical balance", P&P Canada, 85:2 (1984), pp. 31–35.

P.E. Shick, "Development in Recov . . . Cooking Chemicals", Tappi, vol. 56, No. 8, Aug. 1973, pp. 96–98.

*Primary Examiner*—Donald E. Czaja
*Assistant Examiner*—Dean T. Nguyen
*Attorney, Agent, or Firm*—Steinberg, Raskin & Davidson, P.C.

[57] ABSTRACT

To recover the sodium-sulphur compounds following sodium-based pulp processing, e.g. the ASAM process or basic or acidic sodium sulphite processes, the waste liquor is burnt in a lye burning vat (1) with liquid slag extraction and the exhaust gases are subjected to multi-stage purification with dry fly-ash recovery and the gaseous sulphur compounds are also separated in a multi-stage washing process. The water-soluble components of the fly-ash are taken to the waste liquor to be burnt and thus the sulphur to be recovered in the slag is increased. The slag is dissolved in water and the dissolved sodium compounds are converted by multi-stage carbonisation with a part of the purified flue gas into sodium bicarbonate and $H_2S$. The $H_2S$ is burnt and finally converted into sodium sulphite so that the desired lye for pulping cellulose can be made up from sodium sulphite and carbonate.

11 Claims, 3 Drawing Sheets

PROCESS FOR TREATING SULPHUR-CONTAINING SPENT LIQUOR USING MULTI-STAGE CARBONIZATION

PROCESS FOR TREATING SULPHUR-CONTAINING SPENT LIQUOR USING MULTI-STAGE CARBONIZATION

The present invention relates to a process for converting spent liquid containing sodium sulfite and carbonate with sulfate and thiosulfate impurities into cooking liquor containing sodium sulfite and sodium carbonate for an sodium (Na)-based cellulose pulping process or Na-based pulp digestion process, such as, for example, the ASAM process or alkaline or acidic sodium sulfite processes, in which the spent liquor is burned in a liquor burning boiler with liquid slag extraction and a multistage waste gas purification with recovery of the sodium sulfur compound. The waste gases leaving the liquor boiler are first freed of dust in a dry process and are subsequently in one stage, preferably in at least two stages, washed with different washing liquids. The separated dust, in particular the separated $Na_2SO_4$ is mixed with the liquor to be burned and the liquid slag from the liquor burning boiler is dissolved in water. The dissolved sodium compounds, in particular the $Na_2S$ formed, is converted by carbonation with a portion of the purified waste gas to form $NaHCO_3$, $NA_2CO$, and NaHS.

The ASAM process (Alkaline Sulfite Process with Anthraquinone and Methanol addition) is a further development of the neutral or alkaline sulfite process known and used in the industry for centuries. The true innovation in the ASAM process is the addition of methanol to the pulping solution. In comparison to the sulfite and to the sulfate processes, the ASAM process has the advantage that during the digestion, gaseous sulfur compounds do not develop and that the chemical pulp can be bleached to the highest degrees of whiteness without the use of chlorine-containing bleaching agents. Since when using chlorine-free bleaching agents in the digestion as well as also in the various bleaching stages, exclusively sodium is present as the base, the resulting bleaching tower spent liquor can be processed during the pulp washing stage together with the spent liquors from the digester house. The alkali used in the various bleaching stages can be recovered and the possibility is given of largely closing the water cycle of the factory.

With reference to the prior art, several prior art processes will be described.

Austrian Patent No. AT-B 351 359 discloses the removal of NaCI from the digestion liquid without including the solid residues of the waste gas purification.

European Patent Publication No. EP-B1 223 821 discloses a pyrolysis process for the spent liquor in which a portion of the combustible components resulting in the pyrolysis is burned and the inorganic residues are present in the molten state and are quenched. In this process as well, the solid residues from the waste gas purification are not introduced into the smelt.

European Patent Publication No. EP-A1 538 576 discloses the carbonation of the green liquor with $CO_2$-containing gas, such as for example purified waste gas or gas or from the causticizing stage with the formation of $NaHCO_3$ and the release of $H_2S$. The concentration of $H_2S$ is decreased by the nitrogen contained in these gases leading to an increase in the gas volumes to be treated so that large quantities of gas must be supplied to the liquor boiler or must be burned in the $H_2S$ muffle. Moreover, the conversion of the $NaHCO_3$ formed with NaHS to form $Na_2CO_3$ and $H_2S$ leads to an increase of the pH-value and a decrease of the partial pressure of $H_2S$ in the solution as well as to a high requirement of stripping gas as a result.

SUMMARY OF THE INVENTION

It is an object of the present invention to provide a new and improved process for converting sodium sulfate in which the disadvantages of the prior art are avoided.

The invention is based on the task of addressing the problems and of closing the recovery of the chemicals via the cycle of conversion of spent liquor to cooking liquor. The recovery installations have two main functions: the recovery of inorganic pulping chemicals from the spent liquor for the preparation of the cooking liquor as well as the utilization of the energy contained in the organic substance as high-pressure vapor. The value of the recovered chemicals exceeds the value of the required vapor energy.

The invention solves the task and is characterized thereby that the $H_2S$ and $CO_2$ containing slag (green liquor), flowing off from the carbonation, is striped in several stages with $CO_2$ and water vapor and that after every stripping stage $CO_2$ is absorbed at pressures of >1 and the remaining $H_2S$ gas, after the condensation of water vapor, is burned in an $H_2S$ muffle.

Briefly, the process in accordance with the invention is directed to converting spent liquor containing sodium sulfite and carbonate with sulfate and thiosulfate impurities to sodium sulfite and sodium carbonate-containing cooking liquor for an Na-based cellulose pulping process. Particular to Na-based processes are the ASAM process or alkaline or acidic sodium sulfite processes in which the spent liquor is burned in a liquor burning boiler with liquid slag extraction and a multistage waste gas purification with recovery of the sodium sulfur compounds, and waste gases leaving the liquor boiler are first freed of dust in a dry process and subsequently in at least one stage are washed with different washing liquids, and the separated dust including separated $Na_2SO_4$, is mixed with the liquor to be burned, and the liquid slag from the liquid burning boiler is dissolved in water and the dissolved sodium compounds including the $Na_2S$ formed, are converted by sodium compounds including the $Na_2S$ formed, are converted by carbonation with a portion of the purified waste gas to form $NaHCO_3$, $Na_2CO_3$ and NaHS. In such a process, the invention comprising the steps of stripping the $H_2S$ and $CO_2$-containing slag flowing from the carbonation stage with $CO_2$ and water vapor in several stages such that after each stripping stage, $CO_2$ is absorbed at pressures greater than 1 bar, and burning the remaining $H_2S$ gas after the condensation of water vapor in an $H_2S$ muffle.

The $SO_2$ and $H_2S$-containing waste gases of the liquor burning boiler, freed of dust in a dry process, may be washed in a first washing stage at a pH of 6 to 7 with an $Na_2SO_3$ solution to form $NaHSO_3$, the odor-intensive $H_2S$ and mercaptan-containing waste gases flowing off from the first washing stage are then washed in a second washing stage at a pH greater than 7 to form $Na_2SO_4$, the $Na_2SO_4$ being recycled to the spent liquor before it is burned, and lastly the $NaHSO_3$ solution from the first waste gas washing stage of the liquor burning boiler should be directed in least in part to the $SO_2$ washing stage after the muffle, such that the bisulfate formed is subsequently mixed with the carbonated sodium compounds at a pH greater than 6 and the $Na_2SO_3$ formed is used for the liquor as well as for the washing liquid of the first washing stage. The odor-intensive $H_2S$ and mercaptan-containing waste gases flowing off from the first washing stage are preferably washed in the second washing stage with $H_2O_2$.

In addition, the process may entail stripping the dissolved sodium compounds from the smelt in several stages by $CO_2$-containing gases setting free $H_2S$, and providing a bicarbonate splitting stage connected to a last one of the stripping stages to direct $CO_2$ to the last stripping stage such that the end product is $Na_2CO_3$ containing only low levels of $NaHCO_3$ and $H_2S$ impurities and is suitable for causticizing in order to obtain NaOH. The stripping of the $H_2S$ in several stages is preferably carried out at increasing total pressure and increased temperature and fortification with $CO_2$ to bicarbonate at an increased total pressure is performed between sequential stripping stages.

The basic process in accordance with the invention may further entail introducing CaO and $Ca(OH)_2$ into the liquor tank to react with $SO_3$ to form $CaSO_4$, utilizing the resulting $Na_2SO_4$ and $CaSO_4$-containing ash from the dry dust-removal stage with the unreacted calcium compounds in the second washing stage, separating the insoluble calcium compound, and utilizing the concentrated NaOH, $Na_2SO_4$ solution in the second washing stage and the consumed washing solution is supplied to the spent liquor to be burned. In this embodiment, flue ash may be separated from the liquor burning boiler in an electrostatic filter and suspended with water, and sodium carbonate may be added in a clarifier for the complete precipitation of the calcium at pH-values greater than 6 such that insoluble calcium compounds are separated and the thus purified sodium sulfate solution is again supplied to the spent liquor before the mix tank. Also, the resulting flue ash may be separated in an electrostatic filter and suspended in water and at pH-values greater than 7, and then washed with the addition of $H_2O_2$, whereby insoluble calcium compounds are separated in the form of calcium sulfate and calcium and the thus purified sodium sulfate solution is again supplied to the spent liquor before the mix tank. For this latter embodiment, the calcium fractions may be converted with $SO_2$ at pH-values greater than 5.5 to form calcium sulfate in a flue gas washing stage preceding the alkaline washing stage, and the calcium sulfate thus-formed separated from the sodium sulfate solution and supplying the solution thus-formed to the spent liquor.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
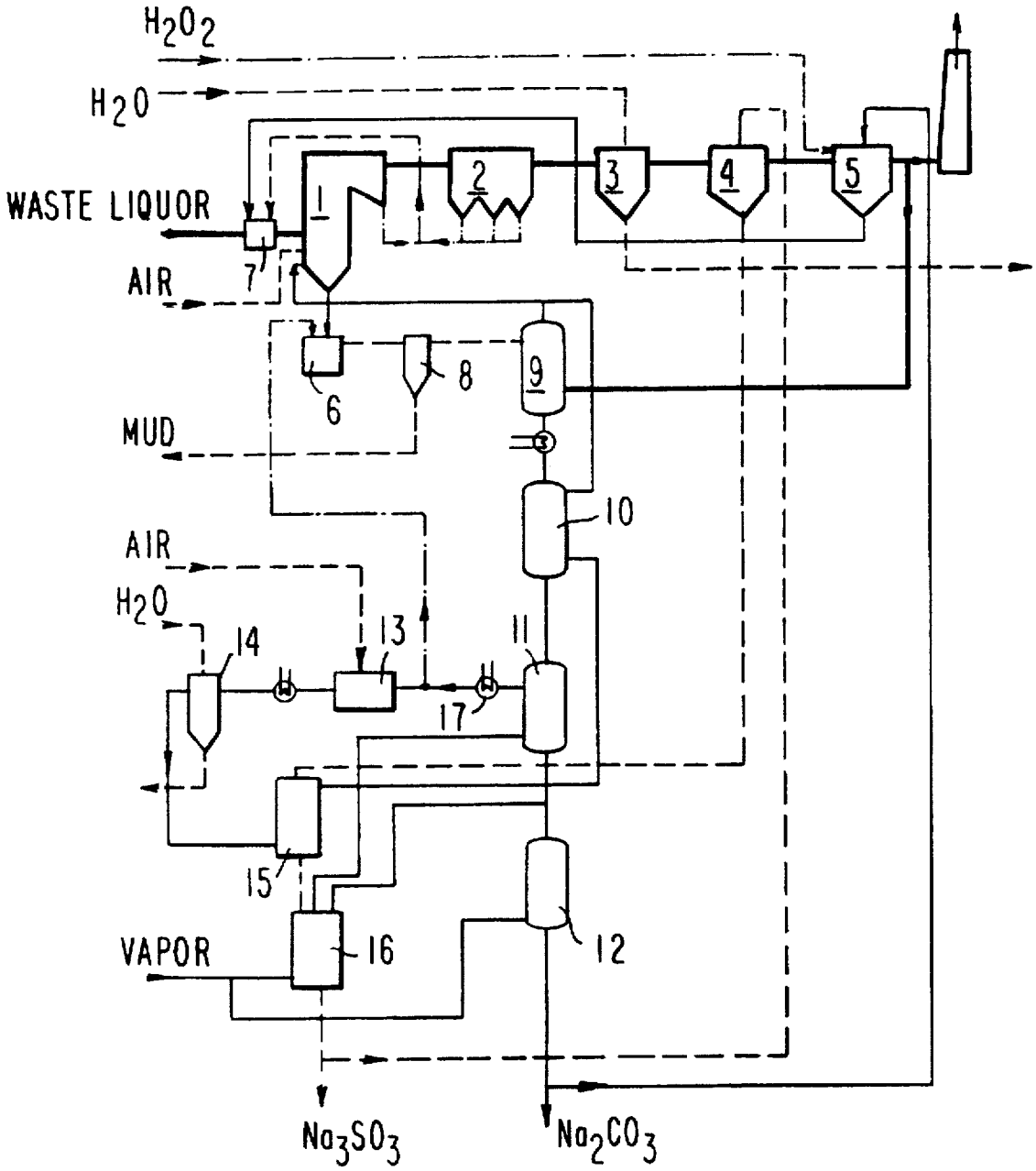
FIG. 1 shows the overall circuit diagram of the process in accordance with the invention.

Referring to the accompanying drawings wherein the same reference numerals refer to the same or similar elements, as shown in FIG. 1, the spent liquor (black liquor) from the evaporation installation (not shown) together with recycled sodium sulfate from an alkaline flue gas washing stage 5 and ash from an electrostatic filter 2 are mixed in a liquor tank 7, the flue gas washing stage 5 and the electrostatic filter 2 being downstream of the liquor tank 7. The mixed spent liquor, ash and sodium sulfate are supplied from the liquor tank 7 to a liquor burning boiler 1. In or after the flue gas washing stage 5, $CASO_4$ can already be separated in the form of an insoluble sediment which reduces the ballast material.

As noted above, the spent liquor is mixed with deposited solid materials in the liquor tank 7 and, analogously to the sulfate process, burned in the liquor burning boiler 1 under reducing conditions in a reduction bed. The resulting smelt from the liquor burning process is extracted at the bottom of the liquor burning chamber of the boiler 1 and the resulting gases are burned with the supply of air via secondary and tertiary air nozzles. The chemical reactions taking place in boiler 1 are essentially the following:

1. $C+\frac{1}{2}O_2 \rightarrow CO+H_2$
2. $CO_2+C \rightarrow 2CO$
3. $H_2O+C \rightarrow CO+H_2$
4. $Na_2SO_4+2C \rightarrow Na_2S+2CO_2$
5. $Na_2SO_4+4C \rightarrow Na_2S+4CO$ These reactions take place in the reducing zone, the CO-containing waste gases are burned to form $CO_2$ through the addition of air. A high degree of reduction is targeted in order to keep the fraction of sodium sulfate low. During the liquor burning a degree of reduction of about 90% can be attained. A high fraction of liquor sulfur is converted to $SO_2$ during the combustion and consequently set free. The incorporation of sulfur into the smelt bed is primarily a function of the boiler load as well as of the ratio of sodium to sulfur and is of the order of magnitude of 65% to 85% for the ASAM liquor.

With $O_2$ values <1 in the waste gas, $H_2S$ occurs in relatively high concentrations, therefore an effective $O_2$ regulation is required in order to keep the $H_2S$ formation low. The $SO_2$ separation takes place in a multistage washing process and about 95% of the accumulating $SO_2$ is washed out with sodium sulfite in the first washing stage 4 and is obtained as the product in the form of sodium sulfite and sodium bisulfate. The residual $SO_2$ separation takes place in the basic washing stages 5 and $H_2O_2$ and the degree to which $H_2S$ is washed out is also high. Another washing stage is represented by 3 in the which the material contained $SO_2$ is washed with water.

The smelt from the boiler 1 is directed into and dissolved in a tank 6 with $H_2O$ and condensates from the conversion and is further subsequently subjected to a decanting process in a decanter 8. The steams from the smelt dissolving reaction may be supplied to the liquor burning boiler 1. Sludge or mud is removed from the decanter 8.

The green liquor containing $Na_2S$, NaHS, and $Na_2CO_3$ is precarbonated, after the decanting stage in the decanter 8, in a multistage wash tank with $CO_2$-containing boiler flue gas with the formation of $NaHCO_2$. The following chemical reactions take place in tank 9:

1. $2Na_2S+CO_2+H_2O \rightarrow 2NaHS+Na_2CO_3$
2. $2Na_2S+2CO_2+H_2O \rightarrow Na_2CO_3+2\ H_2S$
3. $Na_2CO_3+CO_2+H_2O \rightarrow 2NaHCO_3$ This $CO_2$ absorption preferably takes place at increased or elevated pressures and low temperature with the pressure being limited to approximately 1050 to 1060 mbars. The lower temperature limit is determined by the solubility of sodium bicarbonate and should be in the range of 30° C. to 45° C. due to possible reactions in which coatings are formed which can cause disturbances through the precipitation of silicates, it is useful to implement this apparatus as a multistage washing apparatus. To this end, the precarbonated liquor from after precarbonation in the multistage washing tank 9, is directed to and further carbonated in a carbonation process tank 10 with $CO_2$-containing waste gas from the $SO_2$ washing process taking place in tank 15 succeeding $H_2S$ muffle 13. A regulated quantity of air is also directed into the carbonation process tank 10. The following chemical reactions take place in the carbonation process tank 10:

1. $2\ NaHS+H_2O+CO_2 \rightarrow Na_2CO_3+H_2S$
2. $Na_2CO_3+CO_2+H_2O \rightarrow 2\ NaHCO_3$ This $CO_2$ absorption takes place in the same way as during the precarbonation in the washing process 9 at increased or elevated pressure and low temperature and it is useful to implement this apparatus as a multistage apparatus. If sufficient $CO_2$ from the $S_{2O}$ washing process occurring in tank 15 is made available after a saturator 14 positioned intermediate of the $H_2S$ muffle 13 and the tank 15, it is possible to omit the precarbonation process. Since the residual oxygen content of the flue gas after the $H_2S$ combustion in the muffle 13 is significantly lower than in the tank flue gas, a lower degree of oxidation takes place in the washing process in tank 15 from sulfite to sulfate or from hydrogen sulfite to thiosulfate. A regulated quantity of air is directed through the saturator 14. Possible oxidation processes occurring in the liquor in tank 15 are:

1. $Na_2SO_3+\frac{1}{2}O_2 \rightarrow Na_2SO_4$
2. $4\ NaHS+2O_2+CO_2 \rightarrow +Na_2S_2O_3+2H_2S+Na_2CO_3$ The thiosulfate content in the liquor does not interfere with the cooking process in an alkaline environment. It does, however, contribute to an undesirable inactivation of the digestion chemicals.

Figure 2:
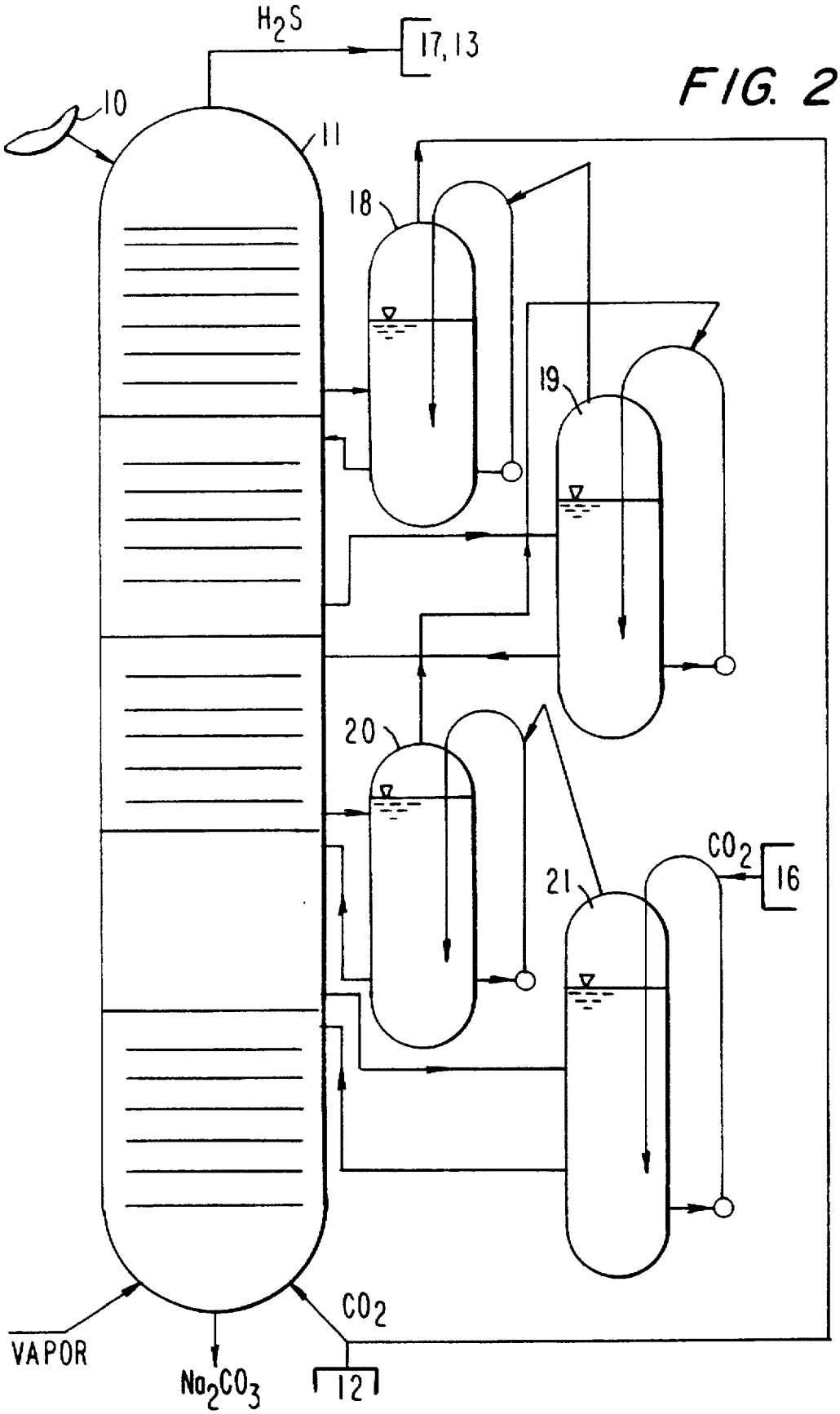
FIG. 2 shows a partial circuit diagram of FIG. 1.

Rational process control of the $H_2S$ stripping requires distribution of the $H_2S$ stripping process occurring in member 11 intermediate of the carbonation process tank 10 and the muffle 13 over several apparatus (as shown most clearly in FIG. 2). Since, due to the two desorption reactions proceeding simultaneously, sodium carbonate is formed in the particular stripping stage, it is therefore necessary to carry out an intermediate fortification with $CO_2$ after each stripping stage in order to convert the carbonate to bicarbonate again and, consequently, to raise the partial pressure of $H_2S$ which determines the transfer of the stock. The two desorption reactions with $H_2S$ and $CO_2$ thus proceed in member 11 as follows:

1. $2\ Na_2HS+CO_2+H_2O \rightarrow Na_2CO_3+H_2S$
2. $2\ NaHCO_3 \rightarrow_{Na2}CO_{3+CO2}+H_2O$
3. $NaHCO_3+NaHS \rightarrow Na_2CO_3+H_2S$ If extensive $H_2S$ stripping is to be achieved, the partial pressure of $H_2S$ in the gaseous phase must be kept low, for the purpose of which $H_2O$ vapor and/or $CO_2$ can be used as a medium, advantageously $H_2O$ vapor is used. The $CO_2$ can be used only to a limited extent from the sulfitation. Consequently, after the condensation of the vapor, $H_2S$ can be obtained at high concentrations for the muffle 13. If the stripping, in contrast to other processes, is carried out without $CO_2$ circulation with concentrated $CO_2$, due to the very similar behavior of carbon dioxide and hydrogen sulfide, process control without splitting of bicarbonate during the stripping is not possible. Partial splitting of the bicarbonate accelerates the substance transition. If the partial pressure of $H_2S$ decreases, as is the case with relatively high fractions of carbonate, this carbonate must again be converted into bicarbonate in the next intermediate fortification stage through the conversion with $CO_2$ in order to shift the partial pressure ratios again toward increased partial pressures of $H_2S$. This adsorption and desorption is controlled alternatingly in several steps. In this way, not only the $CO_2$ fraction can be reduced but large saving of stripping vapor results and high $H_2S$ concentrations.

The reactions by absorption of $CO_2$in the fortification stage from carbonate to bicarbonate is as follows:

$Na_2CO_3+CO_2+H_2O \rightarrow 2\ NaHCO_3$

This $CO_2$ absorption is preferably carried out at increased pressures (>1 bar) and low temperatures. If the carbon dioxide is to be absorbed at increased temperatures, higher pressures are specifically required. As a $CO_2$ source, that carbon dioxide received from a decarbonation process in tank 12 situated after the condensation of the vapor and that of the sulfitation is used.

Figure 3:
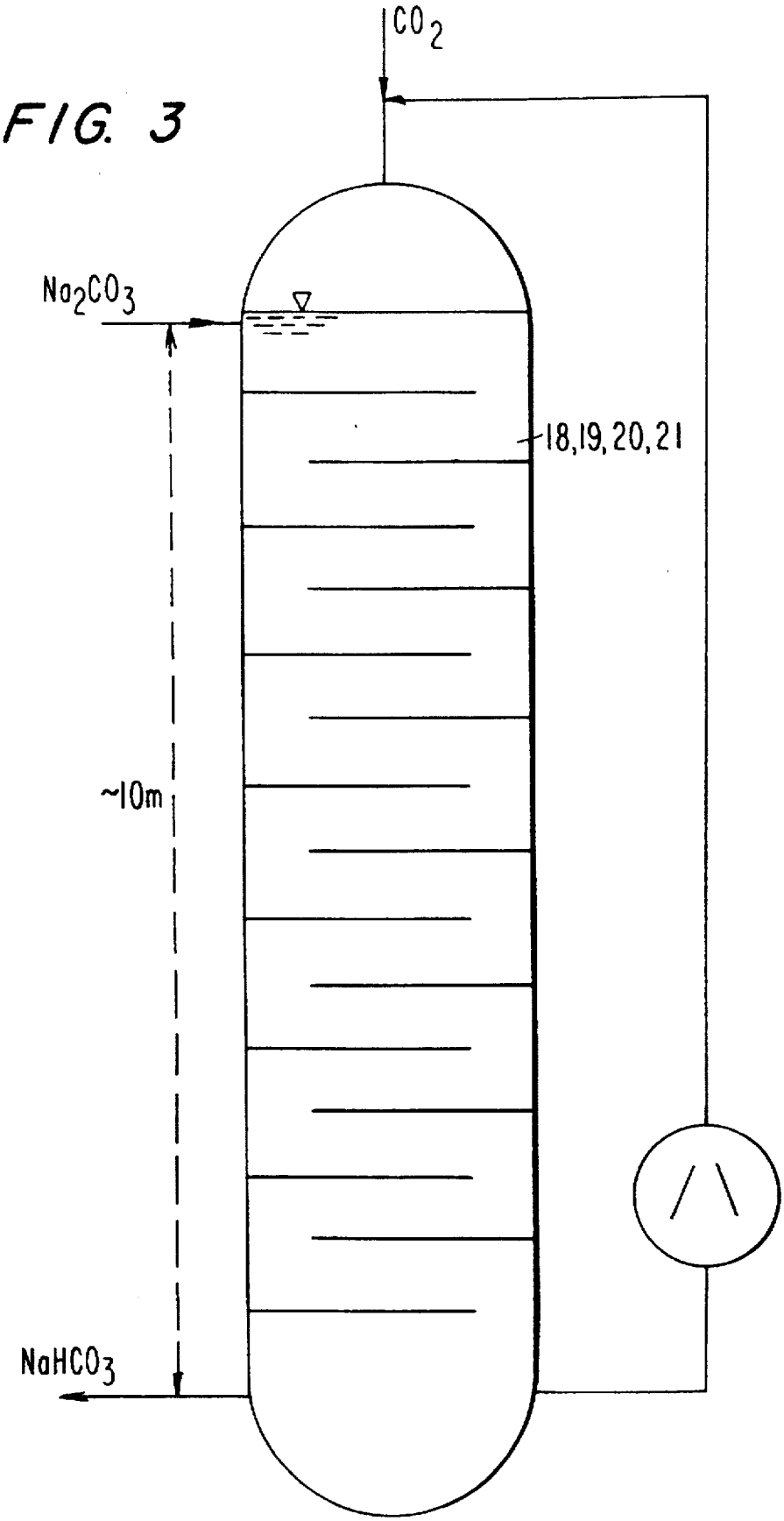
FIG. 3 shows a partial circuit diagram of FIG. 1.

With reference to FIG. 2, the intermediate fortification with $CO_2$ takes place at increased pressure and increasing temperature. The pressure is generated via the geodetic gradient from the stripping stage to the intermediate fortification stage, and the process is carried from the preceding stripping in the downward direction. The absorption of the carbon dioxide is carried out in hydraulic condensers 18, 19, 29, 21 (see FIGS. 2 and 3) in order to ensure sufficient dissolving reaction through a further pressure increase (approximately 2 bars absolute) and high dwelling time of the $CO_2$ in the liquid, with the $CO_2$ gas and the carbonate, bicarbonate solution flowing in opposite directions (see FIG. 3).

The bicarbonate solution saturated with $CO_2$ is drawn into the stripping stage due to its low pressure and further stripping reduces the sulfide content to values less than 1 g/l. The $H_2S$ stripping is carried out in bubble tray columns. The required stage number of more than about 15 trays for each stripping stage represents low apparatus costs.

After separating the water vapor in condenser 17, the highly concentrated $H_2S$ gas from the stripping stages is supplied to the $H_2S$ muffle 13 along with a regulated influx of air. In the muffle 13, the combustion takes place automatically and the released waste heat can be utilized for further overheating of the saturation vapor generated in the liquor burning boiler 1, which is only slightly overheated.

From the $NaHSO_4$ of the acidic flue gas washing process after the liquor burning boiler 1 and the $SO_2$ washing process after the $H_2S$ muffle 13, sodium sulfite is generated in a sulfitation unit 16 with the bicarbonate from the $H_2S$ stripping stage occurring in member 11 and $CO_2$ is obtained in concentrated form. A regulated quantity of vapor is directed into the sulfitation unit 16. A reaction occurring in the sulfitation unit 16 is:

$NaHSO_3+NaHCO_3 \rightarrow Na_2SO_3+H_{2O+CO2}$

That fraction of the bicarbonate after the $H_2S$ stripping stage occurring in member 11, which is not required in the sulfitation unit 16, is supplied to the decarbonation stage 12 after being heated to about 115° C. The $CO_2$ vapor mixture is supplied to the $H_2S$ stripping stage 11. The $Na_2SO_3$ is removed from sulfitation unit 16 and possibly at least a portion thereof is directed to the first washing stage 4.

After these process steps, sodium sulfite and sodium carbonate are actively available as product in concentrations of up to 2.7 mol Na'/1 for cellulose pulping or digestion.

If a further increase of the liquor strength is desired, such as would be required, for example, in the case of preimpregnation, a higher liquor concentration can be achieved through crystallization of bicarbonate and recycling of the mother liquor into the smelt dissolving tank and dissolving of the crystallate in the sulfitation stage. One disadvantage though is a higher energy requirement and, for cooling of the crystallization stage, a greater cooling water requirement.

FIG. 2 depicts in a partial circuit diagram the $H_2S$ stripping stage 11 in which, in several hydraulic condensers 18, 19, 20, 21, $CO_2$ is brought into solution at increasing pressure and increased temperature and allowed to react and between the stripping stages the fortification with $CO_2$ at a total pressure greater than one bar is carried out.

For further increasing the outward transfer of sulfate, the CaO or $Ca(OH)_2$ is introduced into the combustion chamber of the liquor burning boiler 1 so that additionally calcium sulfate is generated which is deposited as an undissolved sediment in the second washing stage 5, while the $Na_2SO_4$ solution is added to the burning spent liquor.

The examples provided above are not meant to be exclusive. Many other variations of the present invention would be obvious to those skilled in the art, and are contemplated to be within the scope of the appended claims.

We claim:

1. Process for converting spent liquor containing sodium sulfite and carbonate with sulfate and thiosulfate impurities to sodium sulfite and sodium carbonate-containing cooking liquor for an ASAM process or alkaline or acidic sodium sulfite process in which the spent liquor is burned in a liquor burning boiler with liquid slag extraction, said liquid slag extraction comprising $Na_2S$ or NaHS and $CO_2$-containing dissolved sodium compounds and a multistage waste gas purification with recovery of the sodium sulfur compounds, and waste gases leaving the liquor boiler are first freed of dust in a very dry process and subsequently in at least one stage are washed with different washing liquids to form a purified waste gas, and the separated dust including separated $Na_2SO_4$, is mixed with the liquor to be burned, and the liquid slag from the liquor burning boiler is dissolved in water and the dissolved sodium compounds including the $Na_2S$ formed, are converted by carbonation with a portion of the purified waste gas to form $NaHCO_3$, $Na_2CO_3$ and NaHS and the dissolved gases $H_2S$ and $CO_2$, the improvement comprising the steps of:

stripping the $H_2S$ and $CO_2$-containing dissolved sodium compounds of the slag flowing from the carbonation stage with $CO_2$ and water vapor in several stages such that after each stripping stage, $CO_2$ is absorbed at pressures of greater than 1 bar, and burning the remaining $H_2S$ gas after the condensation of water vapor in an $H_2S$ muffle.

2. The process of claim 1, further comprising the steps of:

washing the $SO_2$ and $H_2S$-containing waste gases of the liquor burning boiler, freed of dust in a dry process, in a first washing stage at a pH of 6 to 7 with an $Na_2SO_3$ to form $NaHSO_3$, washing the odor-intensive $H_2S$ and mercaptan-containing waste gases flowing off from the first washing stage in a second washing stage at a pH greater than 7 to form $Na_2SO_4$, recycling the $Na_2SO_4$ to the spent liquor before it is burned, and directing the $NaHSO_3$ solution from said first waste gas washing stage of the liquor burning boiler to the $SO_2$ washing stage after the muffle, such that the bisulfite formed is subsequently mixed with the carbonated sodium compounds at a pH greater than about 6 and the $Na_2SO_3$ formed is used for the liquor as well as for the washing liquid of the first washing stage.

3. The process of claim 2, wherein the odor-intensive $H_2S$ and mercaptan-containing waste gases flowing off from the first washing stage are washed in the second washing stage with $H_2O_2$.

4. The process of claim 1, further comprising the steps of:

stripping the dissolved sodium compounds from the smelt in several stages by $CO_2$-containing gases setting free $H_2S$, and providing a bicarbonate splitting stage connected to a last one of said stripping stages to direct $CO_2$ to said last stripping stage such that the end product is $Na_2CO_3$ containing only low levels of $NaHCO_3$ and $H_2S$ impurities and is suitable for causticizing in order to obtain NaOH.

5. The process of claim 1, wherein the stripping of the $H_2S$ in several stages is carried out at increasing total pressure and increasing temperature.

6. The process of claim 1, further comprising the step of introducing additional $CO_2$ to form bicarbonate at an increased total pressure between any two of said several stripping stages.

7. The process of claim 1, further comprising the steps of:

introducing CaO and $CaO(OH)_2$ in dust form into the boiler to react with $SO_3$, to form $CaSO_4$, utilizing the resulting $NaSO_4$ and $CaSO_4$-containing ash from the dry dust-removal stage with the unreacted calcium compounds in the second washing stage, separating the insoluble calcium compound, and utilizing the concentrated NaOH, $Na_2SO_4$ solution in the second washing stage and the consumed washing solution is supplied to the spent liquor to be burned.

8. The process of claim 7, further comprising the steps of:

separating flue ash from the liquor burning boiler in an electrostatic filter and suspending the flue ash with water, and adding sodium carbonate in a clarifier for the complete precipitation of the calcium at pH-values greater than 6 such that insoluble calcium compounds are separated and the thus purified sodium sulfate solution is again applied to the spent liquor before the mix tank.

9. The process of claim 7, further comprising the steps of:

separating the resulting flue ash in an electrostatic filter and suspending the flue ash in water and at pH-values greater than 7, and washing the flue gas with the addition of $H_2O_2$, whereby insoluble calcium compounds are separated in the form of calcium sulfate and calcium and the thus purified sodium sulfate solution is again supplied to the spent liquor before the mixing tank.

10. The process of claim 9, further comprising the steps of:

converting the calcium fractions with $SO_2$ at pH-values greater than 5.5 to form calcium sulfate in a flue gas washing stage preceding the alkaline washing stage, and separating the calcium sulfate thus-formed from the sodium sulfate solution and supplying the solution thus-formed to the spent liquor.

11. A process for converting spent liquor containing sodium sulfite and sodium carbonate with sulfate and thiosulfate impurities into cooking liquor containing sodium sulfite and sodium carbonate, said method comprising the steps of:

burning said spent liquor in a boiler;

extracting liquid slag from said boiler, said liquid slag comprising $Na_2S$ or NaHS, and $CO_2$-containing dissolved sodium compounds;

extracting waste gases from said boiler;

removing dust from said waste gases in a dry process, said dust comprising $Na_2SO_4$;

washing said waste gases to form purified waste gases;

mixing said $Na_2SO_4$ with said spent liquor;

dissolving said liquid slag in water to form dissolved $H_2S$ and $CO_2$-containing sodium compounds;

stripping said $H_2S$ and $CO_2$-containing dissolved sodium compounds with $CO_2$ and water vapor in several stages such that after each stripping stage, $CO_2$ is absorbed at pressures of greater than 1 bar, to form $NaHCO_3$, $Na_2CO_3$ and NaHS and the dissolved gas $H_2S$; and burning the remaining $H_2S$ gas after the condensation of water vapor in an $H_2S$ muffle.

* * * * *